US006400245B1

(12) United States Patent
Castonguay et al.

(10) Patent No.: US 6,400,245 B1
(45) Date of Patent: Jun. 4, 2002

(54) DRAW OUT INTERLOCK FOR CIRCUIT BREAKERS

(75) Inventors: Roger N. Castonguay, Terryville; Girish Hassan, Plainville; Dave S. Christensen, Harwinton, all of CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/687,041

(22) Filed: Oct. 13, 2000

(51) Int. Cl.[7] ..... H01H 9/02

(52) U.S. Cl. ..... 335/202; 335/172; 200/50.05; 218/22

(58) Field of Search ..... 335/167–172, 335/176, 160, 164, 132, 202; 200/50.01–2, 50.05, 50.21, 50.28, 50.37; 361/337–339, 343–345

(56) References Cited

U.S. PATENT DOCUMENTS

| | | | |
|---|---|---|---|
| 2,340,682 | A | 2/1944 | Powell |
| 2,719,203 | A | 9/1955 | Gelzheiser et al. |
| 2,937,254 | A | 5/1960 | Ericson |
| 3,158,717 | A | 11/1964 | Jencks et al. |
| 3,162,739 | A | 12/1964 | Klein et al. |
| 3,197,582 | A | 7/1965 | Norden |
| 3,307,002 | A | 2/1967 | Cooper |
| 3,517,356 | A | 6/1970 | Hanafusa |
| 3,631,369 | A | 12/1971 | Menocal |
| 3,803,455 | A | 4/1974 | Willard |
| 3,883,781 | A | 5/1975 | Cotton |
| 4,129,762 | A | 12/1978 | Bruchet |
| 4,144,513 | A | 3/1979 | Shafer et al. |
| 4,158,119 | A | 6/1979 | Krakik |
| 4,165,453 | A | 8/1979 | Hennemann |
| 4,166,988 | A | 9/1979 | Ciarcia et al. |
| 4,220,934 | A | 9/1980 | Wafer et al. |

(List continued on next page.)

FOREIGN PATENT DOCUMENTS

| | | |
|---|---|---|
| BE | 819 008 A | 12/1974 |
| DE | 12 27 978 | 11/1966 |
| DE | 30 47 360 | 6/1982 |
| DE | 38 02 184 | 8/1989 |
| DE | 38 43 277 | 6/1990 |
| DE | 44 19 240 | 1/1995 |
| EP | 0 061 092 | 9/1982 |
| EP | 0 064 906 | 11/1982 |
| EP | 0 066 486 | 12/1982 |
| EP | 0 076 719 | 4/1983 |
| EP | 0 117 094 | 8/1984 |
| EP | 0 140 761 | 5/1985 |

(List continued on next page.)

*Primary Examiner*—Lincoln Donovan
(74) *Attorney, Agent, or Firm*—Cantor Colburn LLP

(57) ABSTRACT

A draw out interlock mechanism comprises a draw out trip arm pivotally attached in a draw out circuit breaker and an interlock activating assembly attached to a the draw out circuit breaker. The draw out trip arm comprises a first extension on a first end and a second extension on a second end. The first extension is positioned to interact with a trip latch of the operating mechanism. The interlock activating assembly comprises an extended arm and a camming arm, which are pivotally attached to a pin supported by a mounting bracket attached to the draw out circuit breaker. The extended arm extends through an aperture in the draw out circuit breaker with an end thereof proximate to the second extension of the draw out trip arm. The camming arm is adapted to interact with a camming surface attached to the draw out circuit breaker compartment such that when the draw out circuit breaker is inserted into the compartment, the camming arm and the extended arm rotate independently clockwise, the extended arm interacting with the draw out trip arm causing the draw out trip arm to rotate in counterclockwise, which in turn causes the first extension of the draw out trip arm to interact with the trip latch causing the draw out circuit breaker to trip, opening the contacts in the draw out circuit breaker.

13 Claims, 15 Drawing Sheets

U.S. PATENT DOCUMENTS

| | | | | |
|---|---|---|---|---|
| 4,255,732 | A | | 3/1981 | Wafer et al. |
| 4,259,651 | A | | 3/1981 | Yamat |
| 4,263,492 | A | | 4/1981 | Maier et al. |
| 4,276,527 | A | | 6/1981 | Gerbert-Gaillard et al. |
| 4,297,663 | A | | 10/1981 | Seymour et al. |
| 4,301,342 | A | | 11/1981 | Castonguay et al. |
| 4,317,160 | A | | 2/1982 | Tillson et al. |
| 4,360,852 | A | | 11/1982 | Gilmore |
| 4,368,444 | A | | 1/1983 | Preuss et al. |
| 4,375,021 | A | | 2/1983 | Pardini et al. |
| 4,375,022 | A | | 2/1983 | Daussin et al. |
| 4,376,270 | A | | 3/1983 | Staffen |
| 4,383,146 | A | | 5/1983 | Bur |
| 4,392,036 | A | | 7/1983 | Troebel et al. |
| 4,393,283 | A | | 7/1983 | Masuda |
| 4,401,872 | A | | 8/1983 | Boichot-Castagne et al. |
| 4,409,573 | A | | 10/1983 | DiMarco et al. |
| 4,435,690 | A | | 3/1984 | Link et al. |
| 4,467,297 | A | | 8/1984 | Biochot-Castagne et al. |
| 4,468,645 | A | | 8/1984 | Gerbert-Gaillard et al. |
| 4,470,027 | A | | 9/1984 | Link et al. |
| 4,479,143 | A | | 10/1984 | Watanabe et al. |
| 4,488,133 | A | | 12/1984 | McClellan et al. |
| 4,492,941 | A | | 1/1985 | Nagel |
| 4,541,032 | A | | 9/1985 | Schwab |
| 4,546,224 | A | | 10/1985 | Mostosi |
| 4,550,360 | A | | 10/1985 | Doughtery |
| 4,562,419 | A | | 12/1985 | Preuss et al. |
| 4,589,052 | A | | 5/1986 | Dougherty |
| 4,595,812 | A | | 6/1986 | Tamaru et al. |
| 4,611,187 | A | | 9/1986 | Banfi |
| 4,612,430 | A | | 9/1986 | Sloan et al. |
| 4,616,198 | A | | 10/1986 | Pardini |
| 4,622,444 | A | | 11/1986 | Kandatsu et al. |
| 4,631,625 | A | | 12/1986 | Alexander et al. |
| 4,642,431 | A | | 2/1987 | Tedesco et al. |
| 4,644,438 | A | | 2/1987 | Puccinelli et al. |
| 4,649,247 | A | | 3/1987 | Preuss et al. |
| 4,658,322 | A | | 4/1987 | Rivera |
| 4,672,501 | A | | 6/1987 | Bilac et al. |
| 4,675,481 | A | | 6/1987 | Markowski et al. |
| 4,682,264 | A | | 7/1987 | Demeyer |
| 4,689,712 | A | | 8/1987 | Demeyer |
| 4,694,373 | A | | 9/1987 | Demeyer |
| 4,710,845 | A | | 12/1987 | Demeyer |
| 4,717,985 | A | | 1/1988 | Demeyer |
| 4,728,757 | A | | 3/1988 | Buxton et al. |
| 4,733,211 | A | | 3/1988 | Castonguay et al. |
| 4,733,321 | A | | 3/1988 | Lingeperg |
| 4,764,650 | A | | 8/1988 | Bur et al. |
| 4,768,007 | A | | 8/1988 | Mertz et al. |
| 4,780,786 | A | | 10/1988 | Weynachter et al. |
| 4,831,221 | A | | 5/1989 | Yu et al. |
| 4,870,531 | A | | 9/1989 | Danek |
| 4,883,931 | A | | 11/1989 | Batteux et al. |
| 4,884,047 | A | | 11/1989 | Baginski et al. |
| 4,884,164 | A | | 11/1989 | Dziura et al. |
| 4,900,882 | A | | 2/1990 | Bernard et al. |
| 4,910,485 | A | | 3/1990 | Bolongeat-Mobleu et al. |
| 4,914,541 | A | | 4/1990 | Tripodi et al. |
| 4,916,420 | A | | 4/1990 | Bartolo et al. |
| 4,916,421 | A | | 4/1990 | Pardini et al. |
| 4,926,282 | A | | 5/1990 | McGhie |
| 4,935,590 | A | | 6/1990 | Malkin et al. |
| 4,937,706 | A | | 6/1990 | Schueller et al. |
| 4,939,492 | A | | 7/1990 | Raso et al. |
| 4,943,691 | A | | 7/1990 | Mertz et al. |
| 4,943,888 | A | | 7/1990 | Jacob et al. |
| 4,950,848 | A | | 8/1990 | Maier et al. |
| 4,950,855 | A | | 8/1990 | Bolonegeat-Mobleu et al. |
| 4,951,019 | A | | 8/1990 | Gula |
| 4,952,897 | A | | 8/1990 | Barnel et al. |
| 4,958,135 | A | | 9/1990 | Baginski et al. |
| 4,965,543 | A | | 10/1990 | Batteux |
| 4,983,788 | A | | 1/1991 | Pardini |
| 5,001,313 | A | | 3/1991 | Leclerq et al. |
| 5,004,878 | A | | 4/1991 | Seymour et al. |
| 5,029,301 | A | | 7/1991 | Nebon et al. |
| 5,030,804 | A | | 7/1991 | Abri |
| 5,057,655 | A | | 10/1991 | Kersusan et al. |
| 5,077,627 | A | | 12/1991 | Fraisse |
| 5,083,081 | A | | 1/1992 | Barrault et al. |
| 5,095,183 | A | | 3/1992 | Raphard et al. |
| 5,103,198 | A | | 4/1992 | Morel et al. |
| 5,115,371 | A | | 5/1992 | Tripodi |
| 5,120,921 | A | | 6/1992 | DiMarco et al. |
| 5,132,865 | A | | 7/1992 | Mertz et al. |
| 5,138,121 | A | | 8/1992 | Streich et al. |
| 5,140,115 | A | | 8/1992 | Morris |
| 5,153,802 | A | | 10/1992 | Mertz et al. |
| 5,155,315 | A | | 10/1992 | Malkin et al. |
| 5,166,483 | A | | 11/1992 | Kersusan et al. |
| 5,172,087 | A | | 12/1992 | Castonguay et al. |
| 5,178,504 | A | | 1/1993 | Falchi |
| 5,184,717 | A | | 2/1993 | Chou et al. |
| 5,187,339 | A | | 2/1993 | Lissandrin |
| 5,198,956 | A | | 3/1993 | Dvorak |
| 5,200,724 | A | | 4/1993 | Gula et al. |
| 5,210,385 | A | | 5/1993 | Morel et al. |
| 5,239,150 | A | | 8/1993 | Bolongeat-Mobleu et al. |
| 5,260,533 | A | | 11/1993 | Livesey et al. |
| 5,262,744 | A | | 11/1993 | Arnold et al. |
| 5,280,144 | A | | 1/1994 | Bolongeat-Mobleu et al. |
| 5,281,776 | A | | 1/1994 | Morel et al. |
| 5,296,660 | A | | 3/1994 | Morel et al. |
| 5,296,664 | A | | 3/1994 | Crookston et al. |
| 5,298,874 | A | | 3/1994 | Morel et al. |
| 5,300,907 | A | | 4/1994 | Nereau et al. |
| 5,309,317 | A | * | 5/1994 | Ishikawa ..... 361/609 |
| 5,310,971 | A | | 5/1994 | Vial et al. |
| 5,313,180 | A | | 5/1994 | Vial et al. |
| 5,317,471 | A | | 5/1994 | Izoard et al |
| 5,331,500 | A | | 7/1994 | Corcoles et al. |
| 5,334,808 | A | * | 8/1994 | Bur et al. ..... 200/50.01 |
| 5,341,191 | A | | 8/1994 | Crookston et al. |
| 5,347,096 | A | | 9/1994 | Bolongeat-Mobleu et al. |
| 5,347,097 | A | | 9/1994 | Bolongeat-Mobleu et al. |
| 5,350,892 | A | | 9/1994 | Rozier |
| 5,357,066 | A | | 10/1994 | Morel et al. |
| 5,357,068 | A | | 10/1994 | Rozier |
| 5,357,394 | A | | 10/1994 | Piney |
| 5,361,052 | A | | 11/1994 | Ferullo et al. |
| 5,373,130 | A | | 12/1994 | Barrault et al. |
| 5,379,013 | A | | 1/1995 | Coudert |
| 5,424,701 | A | | 6/1995 | Castonguary et al. |
| 5,438,176 | A | | 8/1995 | Bonnardel et al. |
| 5,440,088 | A | | 8/1995 | Coudert et al. |
| 5,449,871 | A | | 9/1995 | Batteux et al. |
| 5,450,048 | A | | 9/1995 | Leger et al. |
| 5,451,729 | A | | 9/1995 | Onderka et al. |
| 5,457,295 | A | | 10/1995 | Tanibe et al. |
| 5,467,069 | A | | 11/1995 | Payet-Burin et al. |
| 5,469,121 | A | | 11/1995 | Payet-Burin |
| 5,475,558 | A | | 12/1995 | Barjonnet et al. |
| 5,477,016 | A | | 12/1995 | Baginski et al. |
| 5,479,143 | A | | 12/1995 | Payet-Burin |
| 5,483,212 | A | | 1/1996 | Lankuttis et al. |
| 5,485,343 | A | | 1/1996 | Santos et al. |
| D367,265 | S | | 2/1996 | Yamagata et al. |
| 5,493,083 | A | | 2/1996 | Olivier |
| 5,504,284 | A | | 4/1996 | Lazareth et al. |

| | | | |
|---|---|---|---|
| 5,504,290 | A | 4/1996 | Baginski et al. |
| 5,510,761 | A | 4/1996 | Boder et al. |
| 5,512,720 | A | 4/1996 | Coudert et al. |
| 5,515,018 | A | 5/1996 | DiMarco et al. |
| 5,519,561 | A | 5/1996 | Mrenna et al. |
| 5,534,674 | A | 7/1996 | Steffens |
| 5,534,832 | A | 7/1996 | Duchemin et al. |
| 5,534,835 | A | 7/1996 | McColloch et al. |
| 5,534,840 | A | 7/1996 | Cuingnet |
| 5,539,168 | A | 7/1996 | Linzenich |
| 5,543,595 | A | 8/1996 | Mader et al. |
| 5,552,755 | A | 9/1996 | Fello et al. |
| 5,581,219 | A | 12/1996 | Nozawa et al. |
| 5,604,656 | A | 2/1997 | Derrick et al. |
| 5,608,367 | A | 3/1997 | Zoller et al. |
| 5,784,233 | A | 7/1998 | Bastard et al. |

FOREIGN PATENT DOCUMENTS

| | | |
|---|---|---|
| EP | 0 174 904 | 3/1986 |
| EP | 0 196 241 | 10/1986 |
| EP | 0 224 396 | 6/1987 |
| EP | 0 235 479 | 9/1987 |
| EP | 0 239 460 | 9/1987 |
| EP | 0 258 090 | 3/1988 |
| EP | 0 264 313 | 4/1988 |
| EP | 0 264 314 | 4/1988 |
| EP | 0 283 189 | 9/1988 |
| EP | 0 283 358 | 9/1988 |
| EP | 0 291 374 | 11/1988 |
| EP | 0 295 155 | 12/1988 |
| EP | 0 295 158 | 12/1988 |
| EP | 0 309 923 | 4/1989 |
| EP | 0 313 106 | 4/1989 |
| EP | 0 313 422 | 4/1989 |
| EP | 0 314 540 | 5/1989 |
| EP | 0 331 586 | 9/1989 |
| EP | 0 337 900 | 10/1989 |
| EP | 0 342 133 | 11/1989 |
| EP | 0 367 690 | 5/1990 |
| EP | 0 371 887 | 6/1990 |
| EP | 0 375 568 | 6/1990 |
| EP | 0 394 144 | 10/1990 |
| EP | 0 394 922 | 10/1990 |
| EP | 0 399 282 | 11/1990 |
| EP | 0 407 310 | 1/1991 |
| EP | 0 452 230 | 10/1991 |
| EP | 0 555 158 | 8/1993 |
| EP | 0 560 697 | 9/1993 |
| EP | 0 567 416 | 10/1993 |
| EP | 0 595 730 | 5/1994 |
| EP | 0 619 591 | 10/1994 |
| EP | 0 655 569 | 8/1995 |
| EP | 0 700 140 | 3/1996 |
| EP | 0 889 498 | 1/1999 |
| FR | 2 410 353 | 6/1979 |
| FR | 2 512 582 | 3/1983 |
| FR | 2 553 943 | 4/1985 |
| FR | 2 592 998 | 7/1987 |
| FR | 2 682 531 | 4/1993 |
| FR | 2 697 670 | 5/1994 |
| FR | 2 699 324 | 6/1994 |
| FR | 2 714 771 | 7/1995 |
| GB | 2 233 155 | 1/1991 |
| WO | 92/00598 | 1/1992 |
| WO | 92/05649 | 4/1992 |
| WO | 94/00901 | 1/1994 |

* cited by examiner

DRAW OUT INTERLOCK FOR CIRCUIT BREAKERS

BACKGROUND OF THE INVENTION

The present invention is directed to circuit breakers, and more particularly to draw out interlock mechanisms therefor.

Industrial-rated draw-out circuit breakers include a pair of connectors (usually male) for each pole on one side of the breaker housing for electrically connecting the draw-out circuit breaker to a compartment, which in turn includes load and line straps for each pole, allowing the draw out circuit breaker to be connected in a power distribution circuit. This configuration allows the circuit breaker to be quickly and easily removed or replaced. The circuit breaker includes movable and fixed contacts for opening and closing the distribution circuit. For safety reasons, the contacts should be open when the draw out circuit breaker is inserted or removed.

Prior art interlock mechanisms have been proposed to prevent insertion or removal of a draw out circuit breaker while the contacts are closed. Such designs include circuit breaker operating mechanisms that are specially designed to cause the circuit breaker to "trip" when the draw out circuit breaker is inserted or removed from the compartment. However it is desirable to provide an interlock mechanism that can be easily added to a standard operating mechanism that is completely assembled to allow for more manufacturing flexibility and to reduce the risk of damaging the interlock mechanism due to handling damage. Furthermore, the design must easily interact with a draw out compartment with the ability to compensate for manufacturing variations.

BRIEF SUMMARY OF THE INVENTION

The above discussed improved design is achieved by a draw out interlock mechanism comprising a draw out trip arm pivotally attached in a draw out circuit breaker and an interlock activating assembly attached to a draw out circuit breaker. The draw out trip arm comprises a first extension on a first end and a second extension on a second end. The extension is positioned to interact with a trip latch of the operating mechanism. The interlock activating assembly comprises an extended arm and a camming arm, which are pivotally attached to a pin supported by a mounting bracket attached to the draw out circuit breaker. The extended arm extends through an aperture in the draw out circuit breaker with an end thereof proximate to the second extension of the draw out trip arm. The camming arm is adapted to interact with a camming surface attached to the draw out circuit breaker compartment such that when the draw out circuit breaker is inserted into the compartment, the carnming arm and the extended arm rotate clockwise, the extended arm interacting with the tab formed on the draw out trip arm causing the draw out trip arm to rotate in counterclockwise, which in turn causes the extension of the draw out trip arm to interact with the trip latch causing the draw out circuit breaker to trip, opening the contacts in the circuit breaker.

BRIEF DESCRIPTION OF THE DRAWINGS

Referring to the FIGS. wherein like elements are numbered alike in the several FIGS.

DETAILED DESCRIPTION OF THE INVENTION

Figure 1:
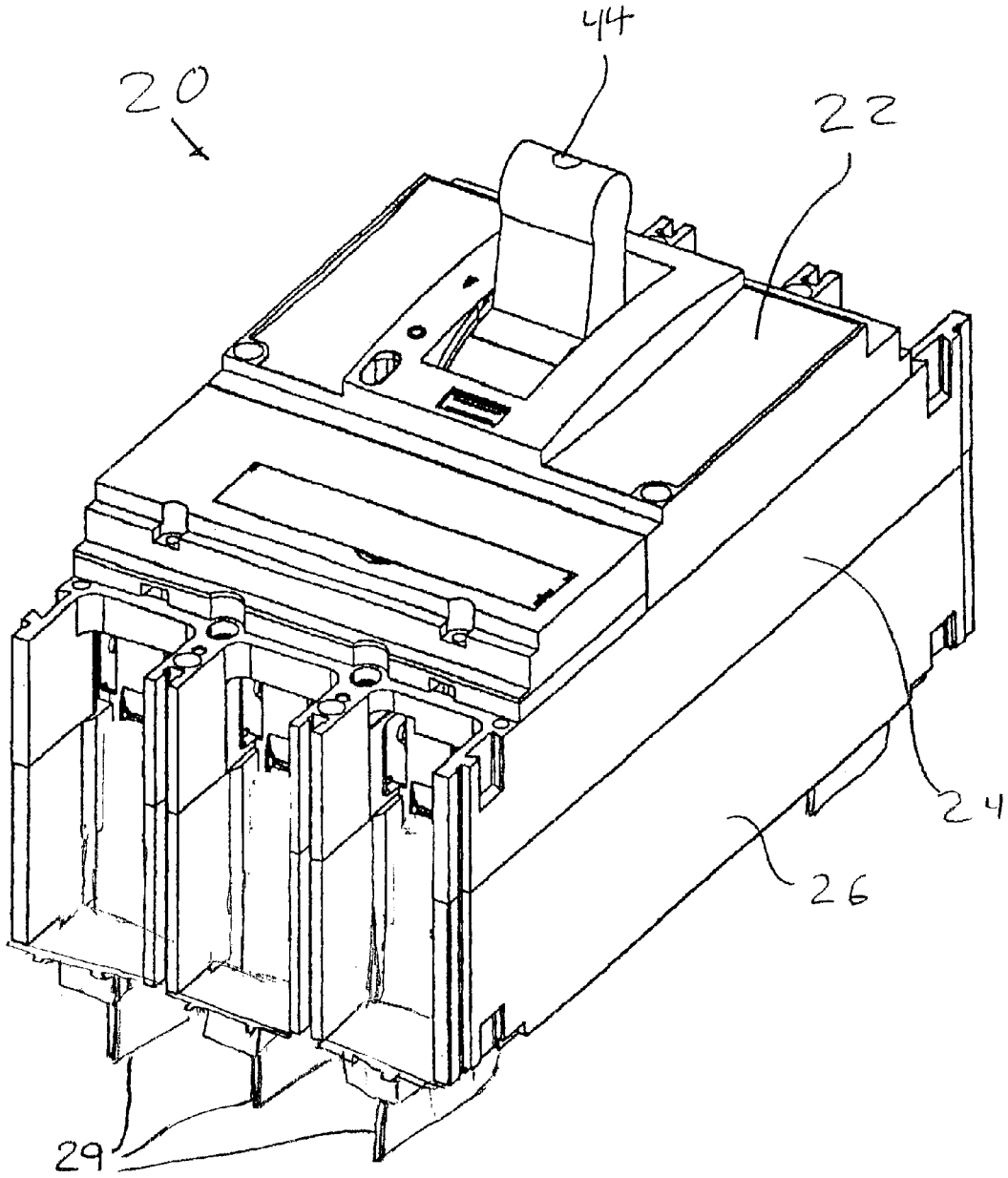
FIG. 1 is an isometric view of a draw out molded case circuit breaker employing an operating.
Figure 2:
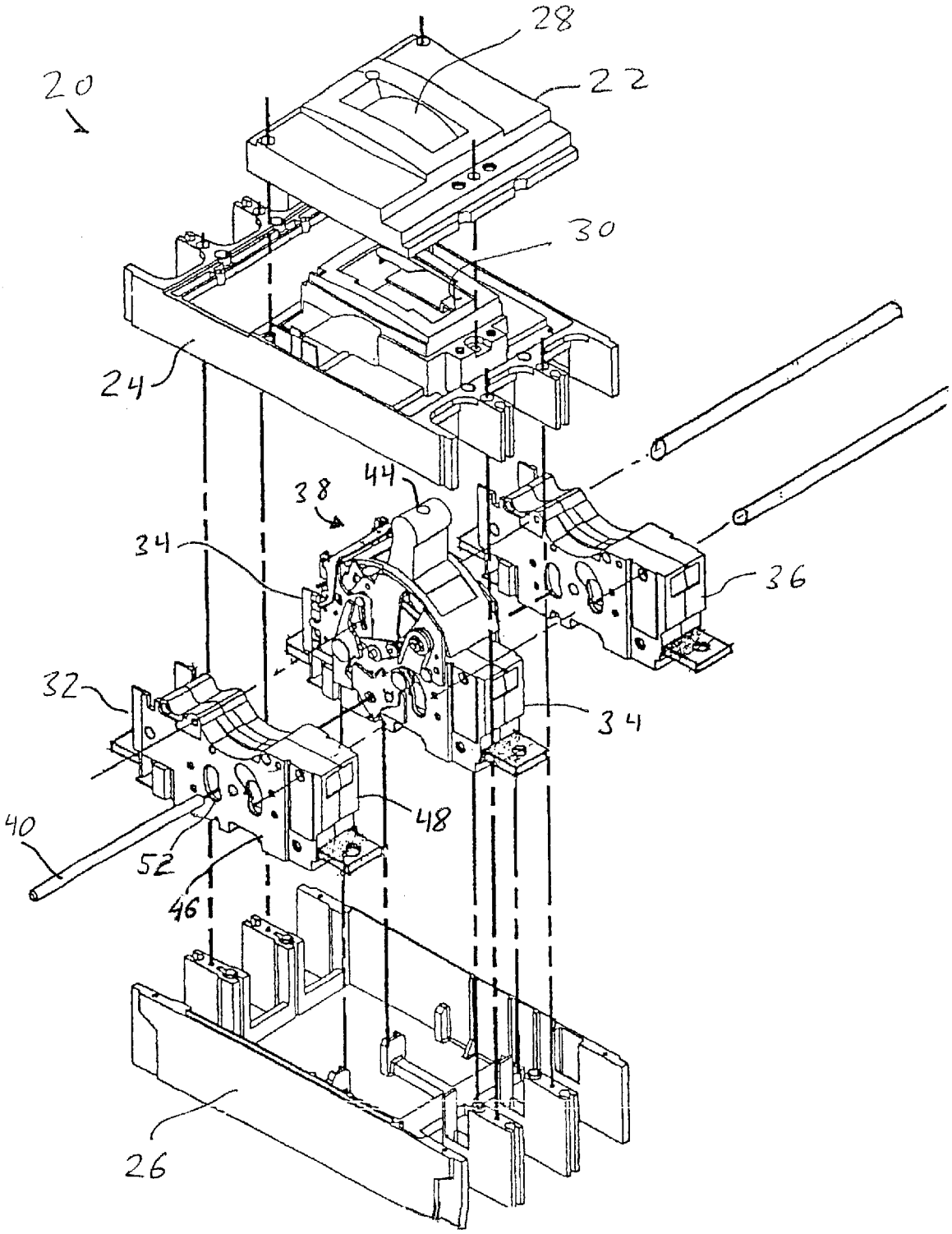
FIG. 2 is an exploded view of the circuit breaker of FIG. 1.

FIGS. 1 and 2 show a circuit breaker 20. Circuit breaker 20 generally includes a molded case having a top cover 22 attached to a mid cover 24 coupled to a base 26. An opening 28, formed generally centrally within top cover 22, is positioned to mate with a corresponding mid cover opening 30, which is accordingly aligned with opening 28 when mid cover 24 and top cover 22 are coupled to one another.

In a 3-pole system (i.e., corresponding with three phases of current), three rotary cassettes 32, 34 and 36 are disposed within base 26. Cassettes 32, 34 and 36 are commonly operated by an interface between an operating mechanism 38 via a cross pin 40. Operating mechanism 38 is positioned and configured atop cassette 34, which is generally disposed intermediate to cassettes 32 and 36. Operating mechanism 38 operates substantially as described herein and as described in U.S. patent application Ser. No. 09/196,706 entitled "Circuit Breaker Mechanism for a Rotary Contact Assembly".

A toggle handle 44 extends through openings 28 and 30 and allows for external operation of cassettes 32, 34 and 36. Examples of rotary contact structures that may be operated by operating mechanism 38 are described in more detail in U.S. patent application Ser. Nos. 09/087,038 and 09/384,908, both entitled "Rotary Contact Assembly For High Ampere Rated Circuit Breakers", and U.S. patent application Ser. No. 09/384,495, entitled "Supplemental Trip Unit For Rotary Circuit Interrupters". Cassettes 32, 34, 36 are typically formed of high strength plastic material and each include opposing sidewalls 46, 48. Sidewalls 46, 48 have an arcuate slot 52 positioned and configured to receive and allow the motion of cross pin 40 by action of operating mechanism 38.

Figure 4:
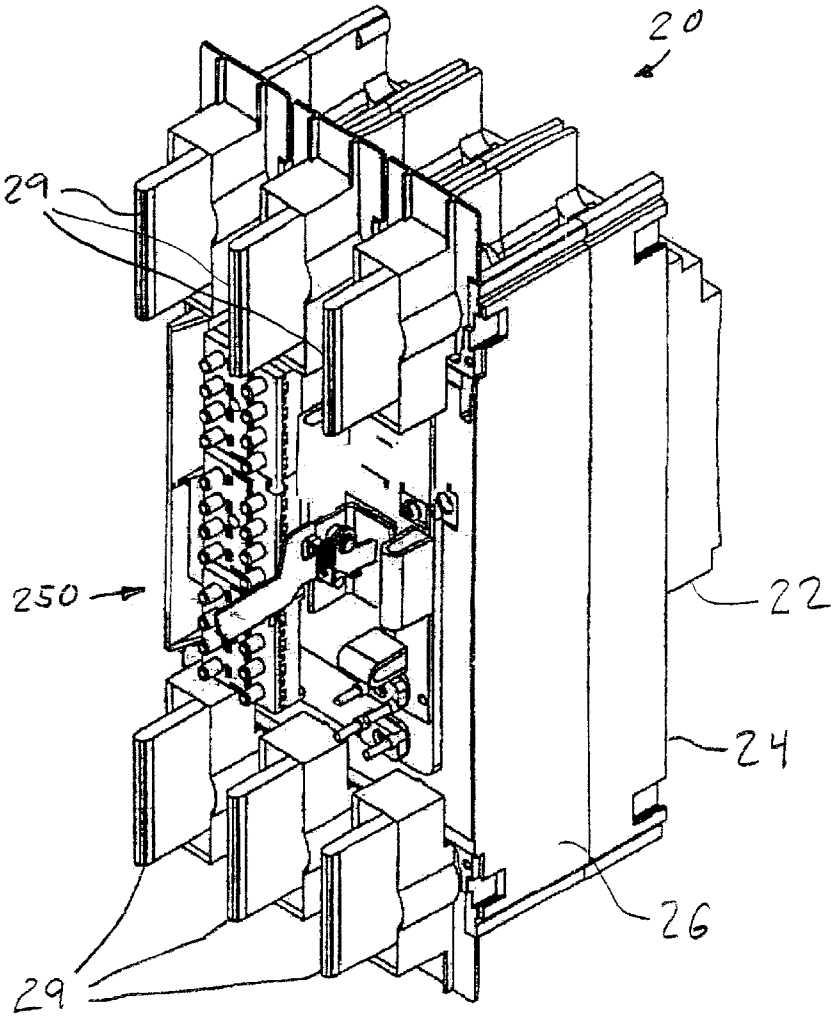
FIG. 4 is a reverse view of the draw out molded case circuit breaker shown in FIG. 1.
Figure 3:
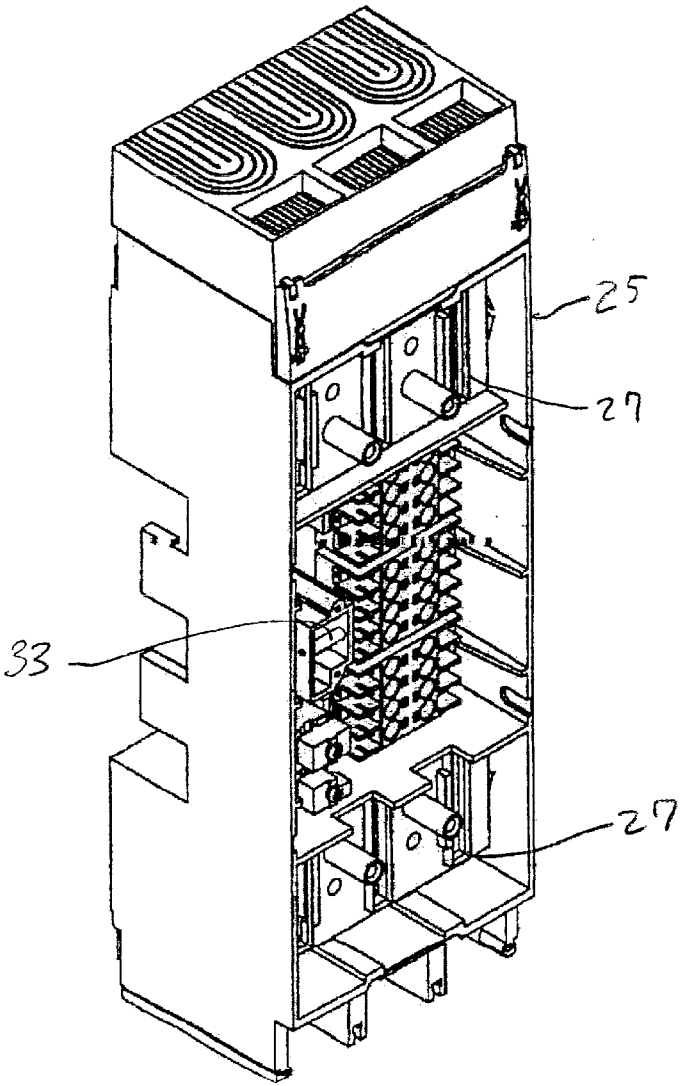
FIG. 3 is an isometric view of a draw out circuit breaker compartment.

FIGS. 3 and 4 show matable circuit draw out circuit breaker compartment 25 and circuit breaker 20. Each cassette 32, 34, 36 (FIG. 2) is connected in series with a pair of stabs 29. Draw out interlock mechanism 250, which will be discussed in detail below, can be seen protruding from the back side of circuit breaker 20. To connect circuit breaker 20 to a power distribution circuit, it is simply plugged into compartment 25 so that stabs 29 are inserted into corresponding sockets 27. While stabs 29 and sockets 27 may be sufficient to mechanically support circuit breaker 20 in compartment 25, there may be supplemental mechanical connections, such as a screw or locking means (not shown) to provide a positive mechanical connection between circuit breaker 20 and compartment 25. Additionally, mechanical means, such as a lever, jack screw, or release spring may be provided to aid in the removal of circuit breaker 20 from compartment 25 when desired.

Figure 5:
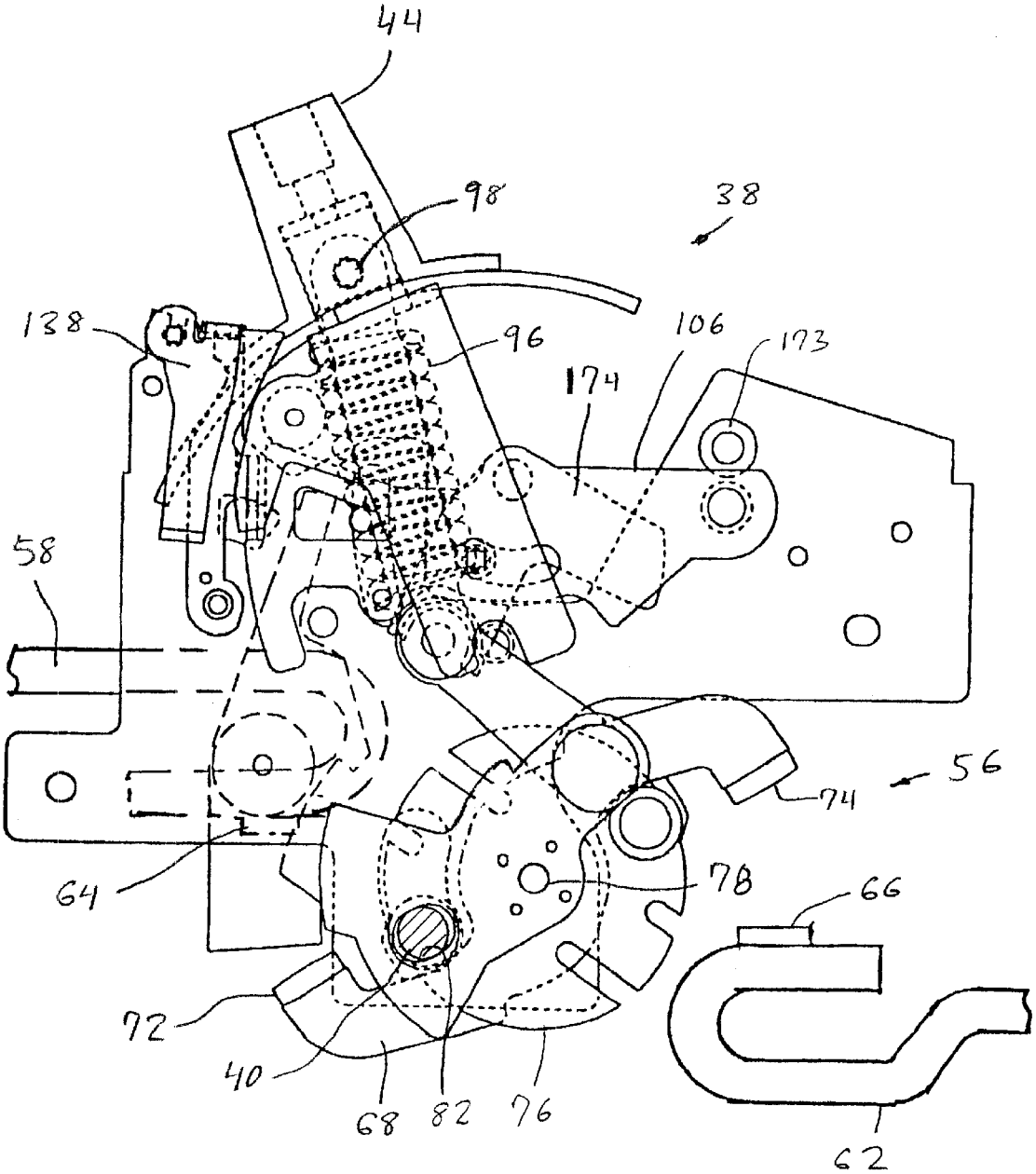
FIG. 5 is a partial sectional view of a rotary contact structure and operating mechanism in the "off" position.
Figure 6:
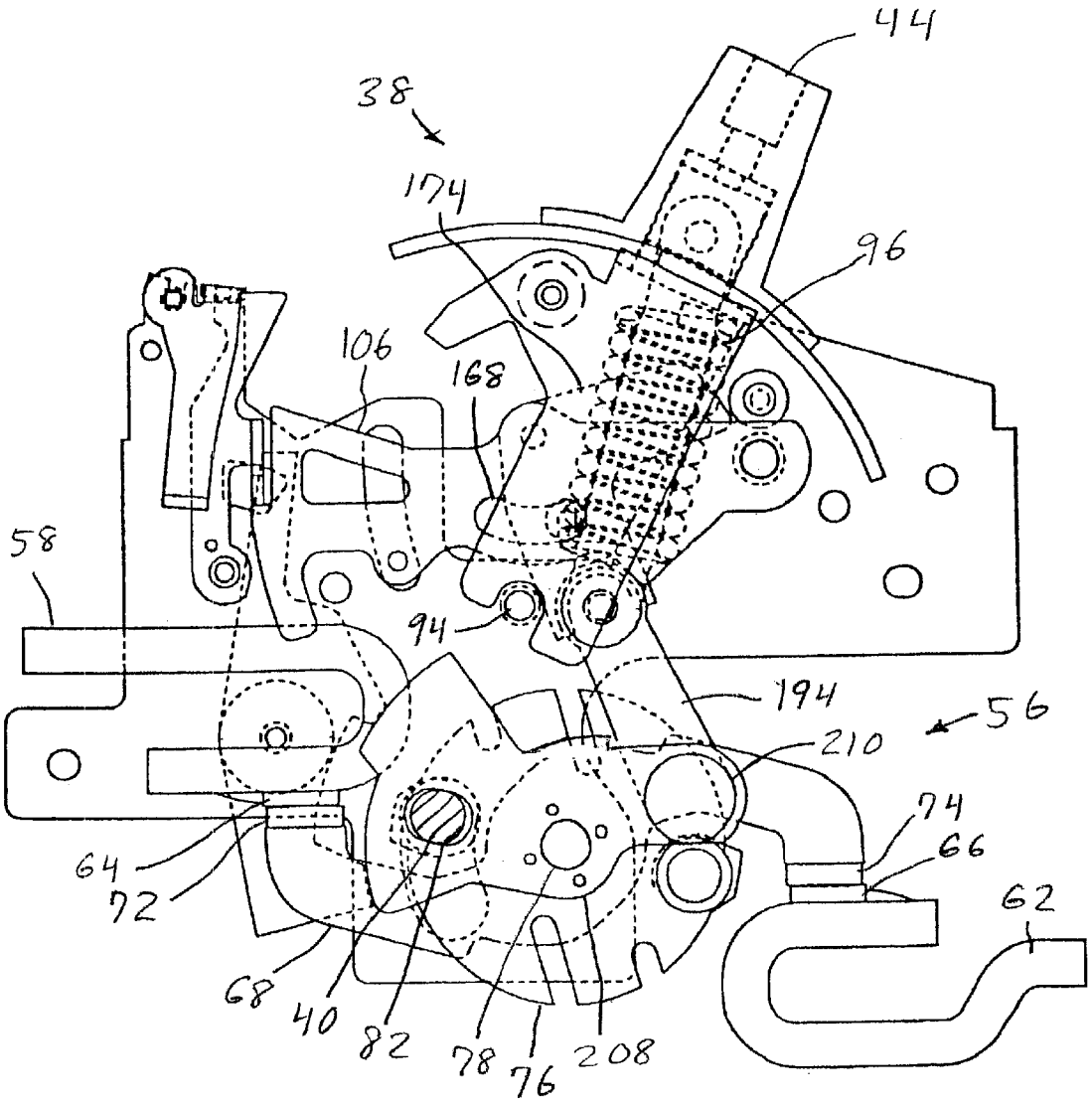
FIG. 6 is a partial sectional view of the rotary contact structure and operating mechanism of FIG. 3 in the "on" position.
Figure 7:
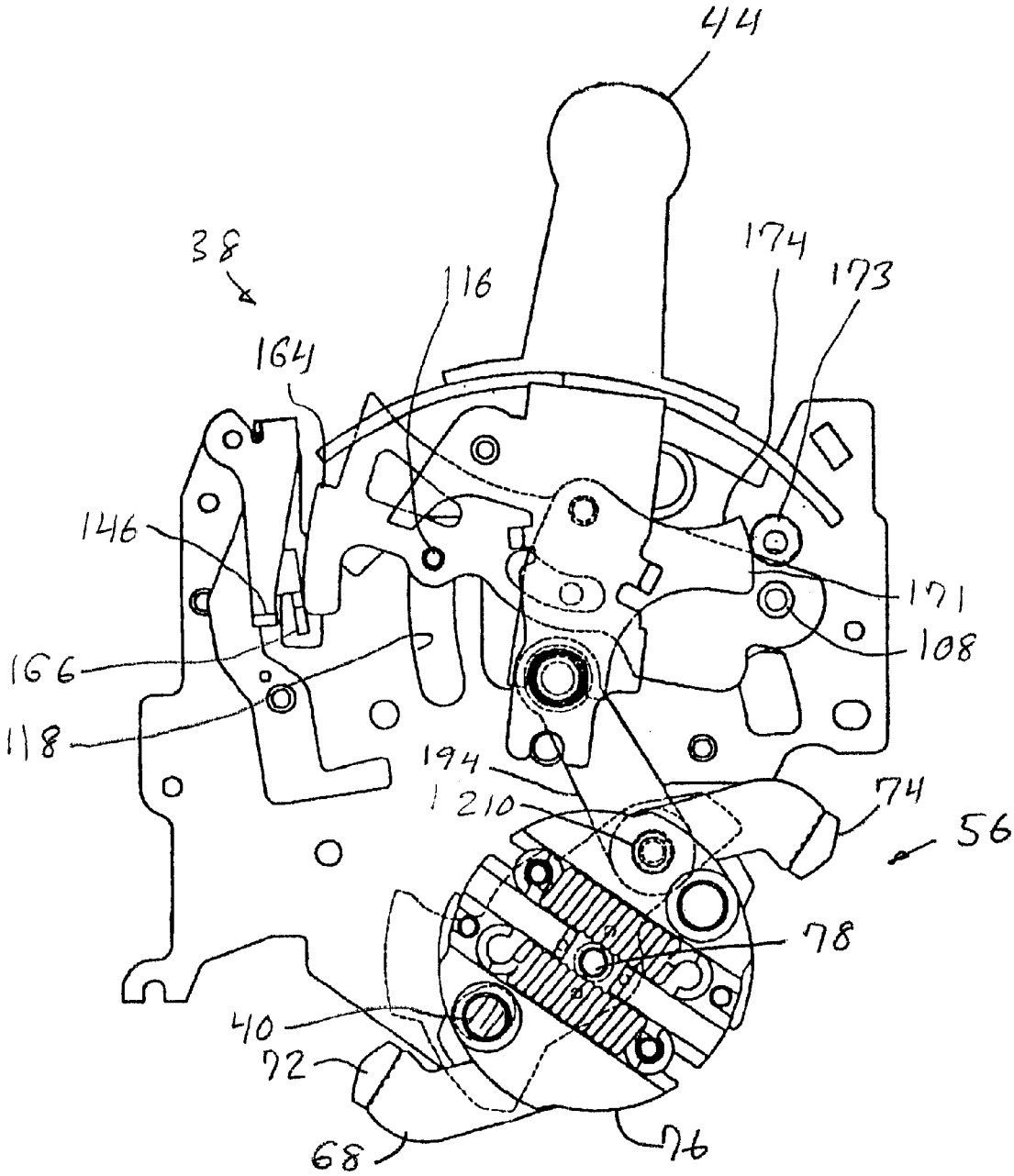
FIG. 7 is a partial sectional view of the rotary contact structure and operating mechanism of FIGS. 3 and 4 in the "tripped" position.

Referring now to FIGS. 5, 6, and 7, an exemplary rotary contact assembly 56 that is disposed within each cassette 32, 34, 36 is shown in the "off", "on" and "tripped" conditions, respectively. Also depicted are partial side views of operating mechanism 38, the components of which are described in greater detail further herein. Rotary contact assembly 56 includes a load side contact strap 58 and line side contact strap 62 for connection via stabs 29 (FIG. 4) to a power source and a protected circuit (not shown), respectively. Load side contact strap 58 includes a stationary contact 64 and line side contact strap 62 includes a stationary contact 66. Rotary contact assembly 56 further includes a movable contact arm 68 having a set of contacts 72 and 74 that mate with stationary contacts 64 and 66, respectively. In the "off" position (FIG. 5) of operating mechanism 38, wherein toggle handle 44 is oriented to the left (e.g., via a manual or mechanical force), contacts 72 and 74 are separated from stationary contacts 64 and 66, thereby preventing current from flowing through contact arm 68. It should be appreciated that while rotary contact assembly 56 shows a contact arm having a pair of movable contacts, rotary contact assemblies wherein the contact arm has only a single movable contact is contemplated.

In the "on" position (FIG. 6) of operating mechanism 38, wherein toggle handle 44 is oriented to the right as depicted in FIG. 3 (e.g., via a manual or mechanical force), contacts 72 and 74 are mated with stationary contacts 64 and 66, thereby allowing current to flow through contact arm 68. In the "tripped" position (FIG. 7) toggle handle 44 is oriented between the "on" position and the "off" position (typically by the release of mechanism springs within operating mechanism 38, described in greater detail herein). In this "tripped" position, contacts 72 and 74 are separated from stationary contacts 64 and 66 by the action of operating mechanism 38, thereby preventing current from flowing through contact arm 68. After operating mechanism 38 is in the "tripped" position, it must ultimately be returned to the "on" position for operation. This is effectuated by applying a reset force to move toggle handle 44 to a "reset" condition, which is beyond the "off" position (i.e., further to the left of the "off" position in FIG. 3), and then back to the "on" position. This reset force must be high enough to overcome the mechanism springs, described herein.

Contact arm 68 is mounted on a rotor structure 76 that houses one or more sets of contact springs (not shown). Contact arm 68 and rotor structure 76 pivot about a common center 78. Cross pin 40 interfaces through an opening 82 within rotor structure 76 generally to cause contact arm 68 to be moved from the "on", "off" and "tripped" position.

Figure 8:
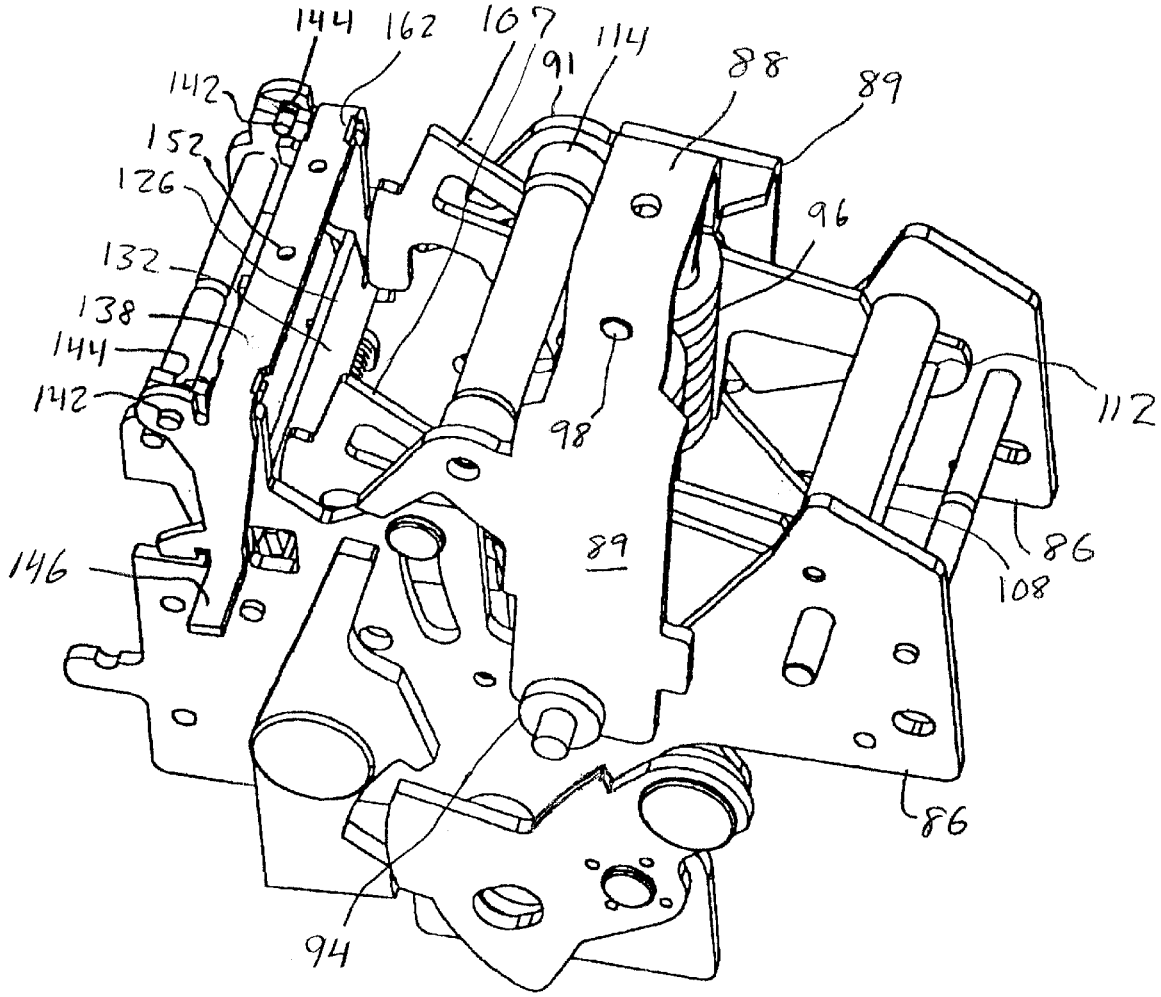
FIG. 8 is an isometric view of the operating mechanism.
Figure 9:
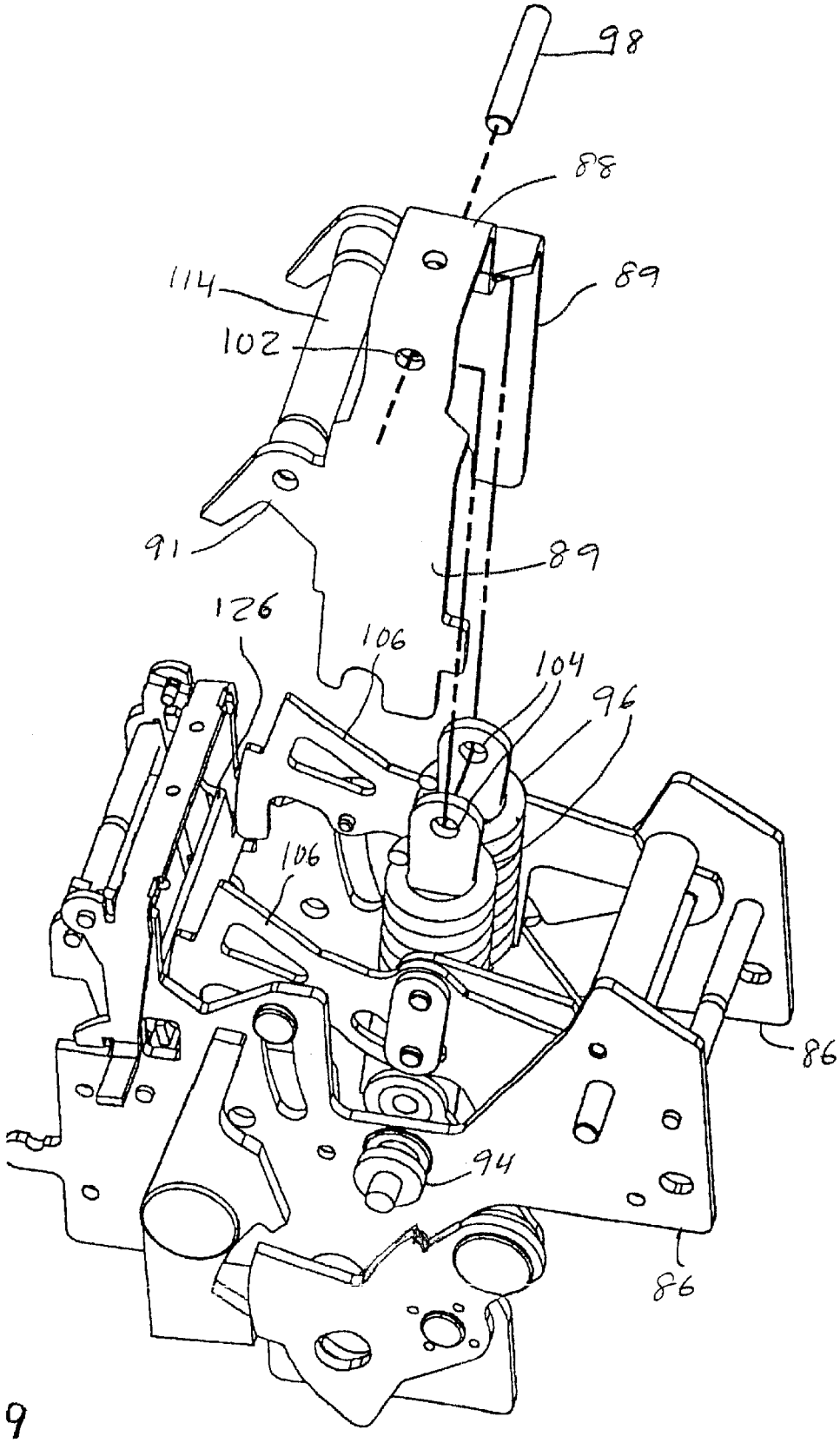
FIG. 9 is a partially exploded view of the operating mechanism.
Figure 10:
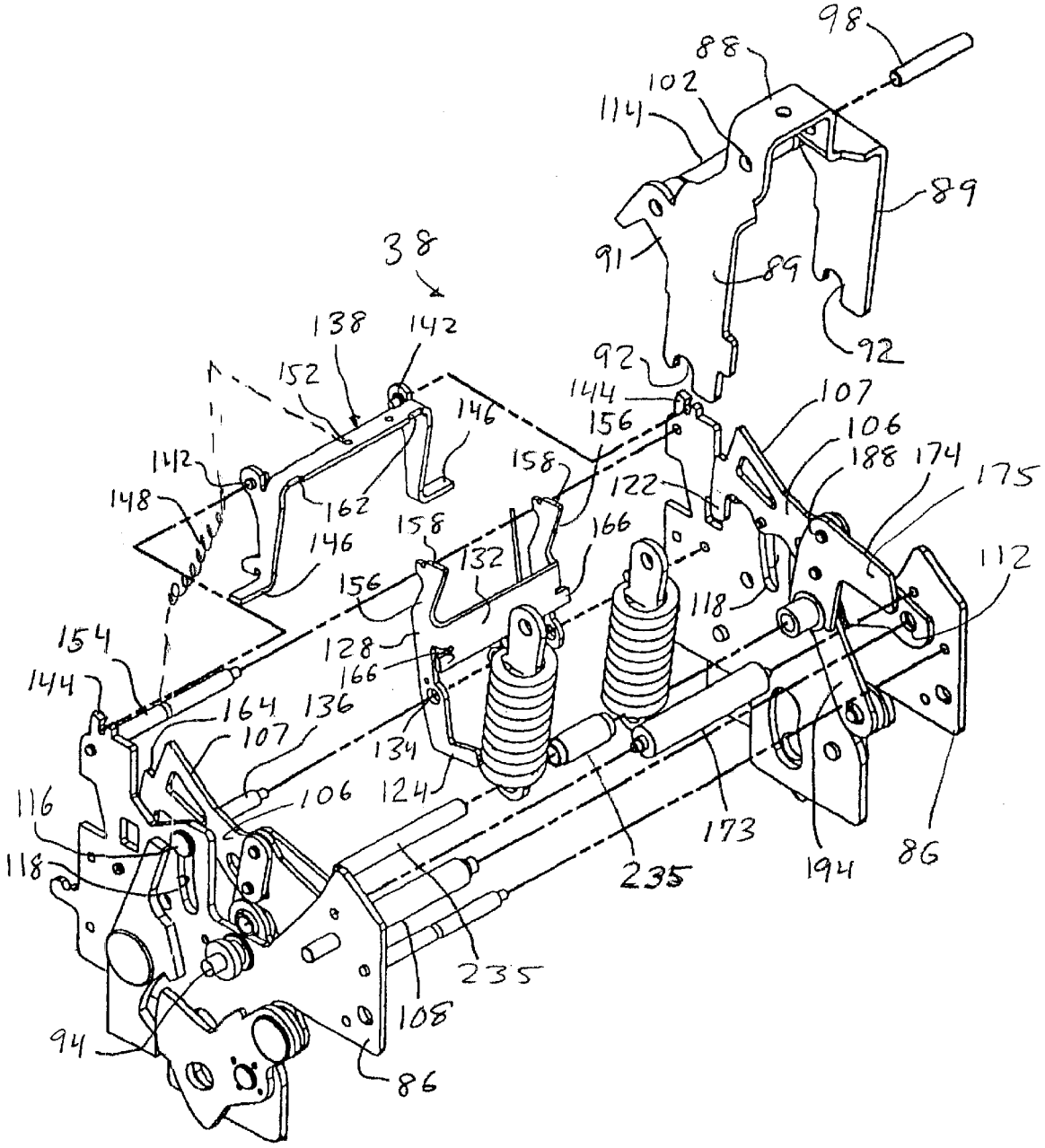
FIG. 10 is another partially exploded view of the operating mechanism.

Referring now to FIGS. 8–10, the components of operating mechanism 38 will now be detailed. As viewed in FIGS. 8–10, operating mechanism 38 is in the "tripped" position. Operating mechanism 38 has operating mechanism side frames 86 configured and positioned to straddle sidewalls 46, 48 of cassette 34 (FIG. 2).

Toggle handle 44 (FIG. 2) is rigidly interconnected with a drive member or handle yoke 88. Handle yoke 88 includes opposing side portions 89. Each side portion 89 includes an extension 91 at to the top of side portion 89, and a U-shaped portion 92 at the bottom portion of each side portion 89. U-shaped portions 92 are rotatably positioned on a pair of bearing portions 94 protruding outwardly from side frames 86. Bearing portions 94 are configured to retain handle yoke 88, for example, with a securement washer. Handle yoke 88 further includes a roller pin 114 extending between extensions 91.

Handle yoke 88 is connected to a set of powerful mechanism springs 96 by a spring anchor 98, which is generally supported within a pair of openings 102 in handle yoke 88 and arranged through a complementary set of openings 104 on the top portion of mechanism springs 96.

Figure 11:
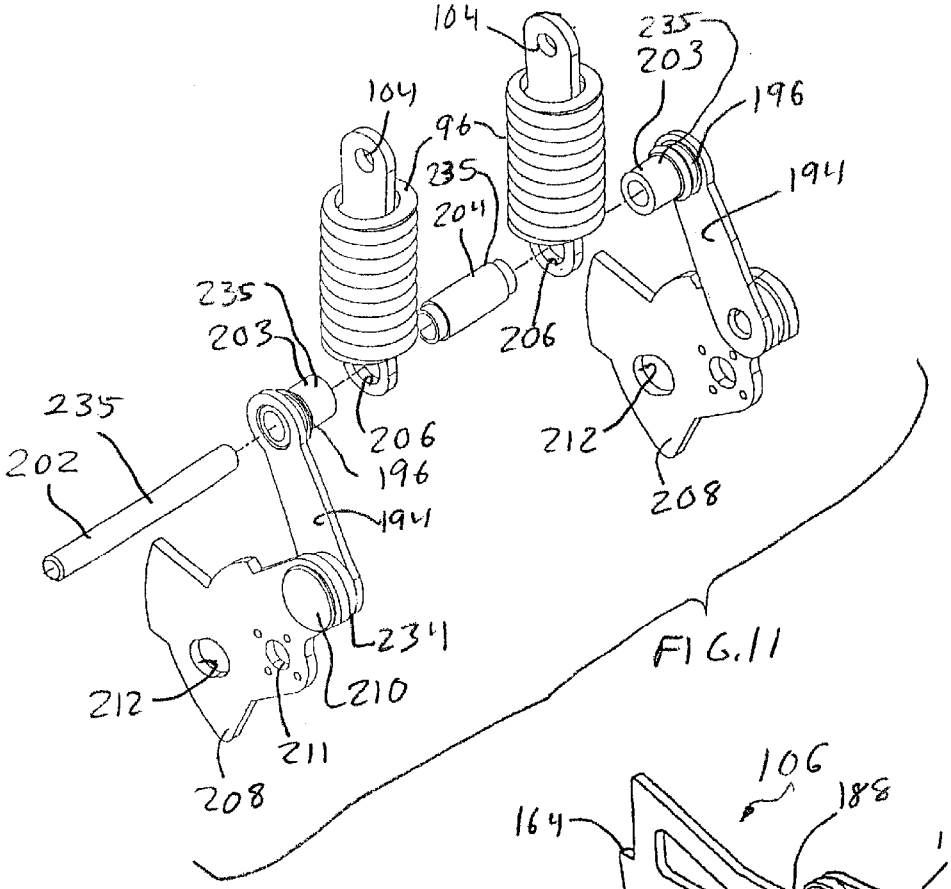
FIG. 11 is an exploded view of a pair of mechanism springs and associated linkage components within the operating mechanism.

Referring to FIG. 11, the bottom portion of mechanism springs 96 include a pair of openings 206. A drive connector 235 operative couples mechanism springs 96 to other operating mechanism components. Drive connector 235 comprises a pin 202 disposed through openings 206, a set of side tubes 203 arranged on pin 202 adjacent to the outside surface of the bottom portion of mechanism springs 96, and a central tube 204 arranged on pin 202 between the inside surfaces of the bottom portions of mechanism springs 96. Central tube 204 includes step portions at each end, generally configured to maintain a suitable distance between mechanism springs 96. While drive connector 235 is detailed herein as tubes 203, 204 and a pin 202, any means to connect the springs to the mechanism components are contemplated.

Figure 13:
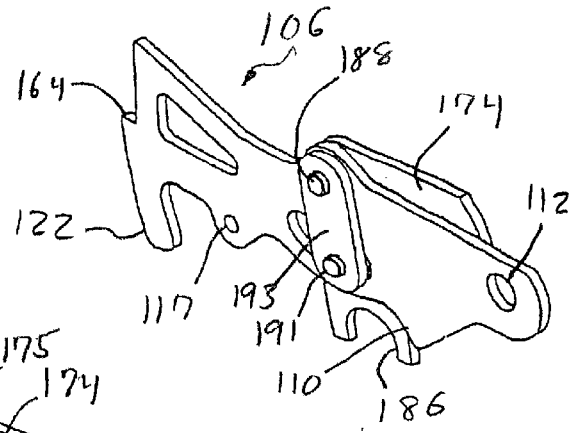
FIGS. 12 and 13 are an isometric and exploded view, respectively, of linkage components within the operating mechanism.
Figure 12:
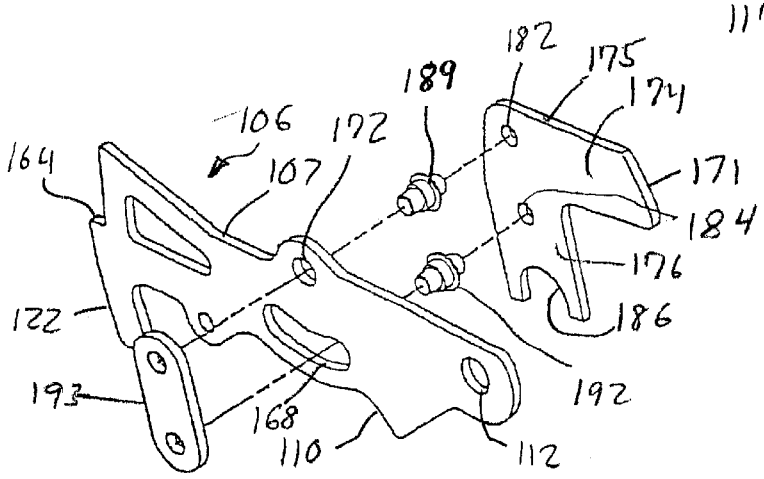
Figure 14:
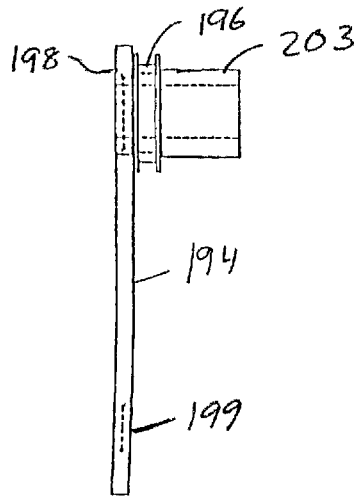
FIGS. 14, 15, and 16 are a front, isometric, and partially exploded isometric views, respectively, of a linkage component within the operating mechanism.
Figure 15:
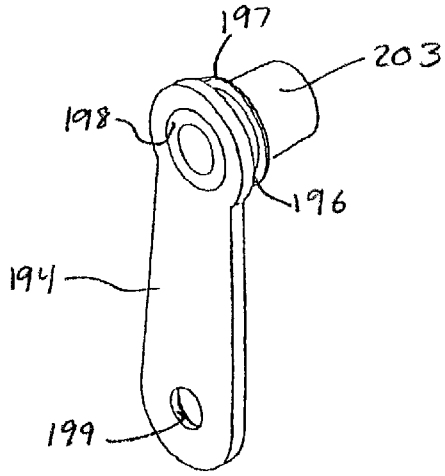
Figure 16:
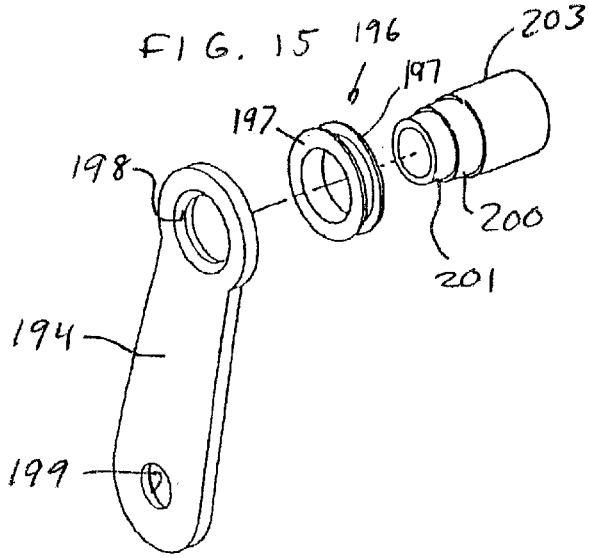

Referring to FIGS. 10, 12, and 13, a pair of cradles 106 are disposed adjacent to side frames 86 and pivot on a pin 108 disposed through an opening 112 approximately at the end of each cradle 106. Each cradle 106 includes an edge surface 107, an arm 122 depending downwardly, and a cradle latch surface 164 above arm 122. Edge surface 107 is positioned generally at the portion of cradle 106 in the range of contact with roller pin 114. Each cradle 106 also includes a stop surface 110 formed thereon. A rivet 116 disposed through an arcuate slot 118 within each side frame 86, as best seen in FIGS. 7 and 10, guides the movement of each cradle 106. Rivets 116 are disposed within an opening 117 on each cradle 106 (FIG. 13). An arcuate slot 168 is positioned intermediate to opening 112 and opening 117 on each cradle 106. An opening 172 is positioned above slot 168.

Referring back to FIGS. 8–10, a primary latch 126 is positioned within side frames 86. Primary latch 126 includes a pair of side portions 128 (FIG. 10). Each side portion 128 includes a bent leg 124 at the lower portion thereof. Side portions 128 are interconnected by a central portion 132. A set of extensions 166 depend outwardly from central portion 132 positioned to align with cradle latch surfaces 164.

Side portions 128 each include an opening 134 positioned so that primary latch 126 is rotatably disposed on a pin 136. Pin 136 is secured to each side frame 86. A set of upper side portions 156 are defined at the top end of side portions 128. Each upper side portion 156 has a primary latch surface 158.

A secondary latch 138 is pivotally straddled over side frames 86. Secondary latch 138 includes a set of pins 142 disposed in a complementary pair of notches 144 on each side frame 86. Secondary latch 138 includes a pair of secondary latch trip tabs 146 that extend perpendicularly from operating mechanism 38 as to allow an interface with the draw out interlock mechanism 250, as will be further discussed below. Actuation by draw out interlock mechanism 250 causes secondary latch 138 to release the engagement with primary latch 126 thereby causing operating mechanism 38 to move to the "tripped" position (e.g., as in FIG. 5), described below. Secondary latch 138 includes a set of latch surfaces 162, that align with primary latch surfaces 158.

Secondary latch 138 is biased in the clockwise direction due to the pulling forces of a spring 148 (FIG. 10). Spring 148 has a first end connected at an opening 152 upon secondary latch 138, and a second end connected at a frame cross pin 154 disposed between frames 86.

Referring to FIGS. 10, 12 and 13, a set of upper links 174 are connected to cradles 106. Upper links 174 generally have a right angle shape. Legs 175 (in a substantially horizontal configuration in FIGS. 10 and 12) of upper links 174 each have a cam portion 171 that interfaces a roller 173 disposed between frames 86. Legs 176 (in a substantially vertical configuration in FIGS. 10 and 12) of upper links 174 each have a pair of openings 182, 184 and a U-shaped portion 186 at the bottom end thereof. Opening 184 is intermediate to opening 182 and U-shaped portion 186. Upper links 174 connect to cradle 106 via a securement structure such as a rivet pin 188 disposed through opening 172 and opening 182, and a securement structure such as a rivet pin 191 disposed through slot 168 and opening 184. Rivet pins 188, 191 both attach to a connector 193 to secure each upper link 174 to each cradle 106. Each pin 188, 191 includes raised portions 189, 192, respectively. Raised portions 189, 192 are provided to maintain a space between each upper link 174 and each cradle 106. The space serves to reduce or eliminate friction between upper link 174 and cradle 106 during any operating mechanism motion, and also to spread force loading between cradles 106 and upper links 174.

Upper links 174 are each interconnected with a lower link 194. Referring now to FIGS. 10–16, U-shaped portion 186 of each upper link 174 is disposed in a complementary set of bearing washers 196. Bearing washers 196 are arranged on each side tube 203 between a first step portion 200 of side tube 203 and an opening 198 at one end of lower link 194. Bearing washers 196 are configured to include side walls 197 spaced apart sufficiently so that U-shaped portions 186 of upper links 174 fit in bearing washer 196. Each side tube 203 is configured to have a second step portion 201. Each second step portion 201 is disposed through openings 198. Pin 202 is disposed through side tubes 203 and central tube 204. Pin 202 interfaces upper links 174 and lower links 194 via side tubes 203. Therefore, each side tube 203 is a common interface point for upper link 174 (as pivotally seated within side walls 197 of bearing washer 196), lower link 194 and mechanism springs 96.

Figure 17:
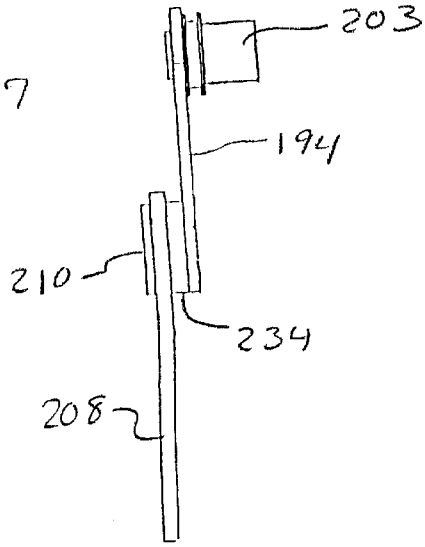
FIGS. 17, 18, and 19 are a front, isometric, and partially exploded isometric view, respectively, of linkage components within the operating mechanism.
Figure 18:
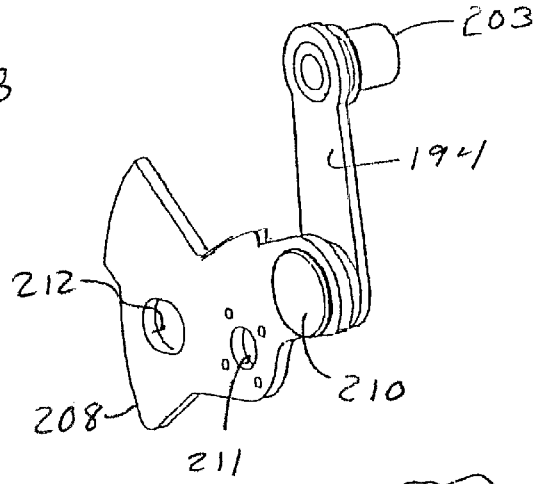
Figure 19:
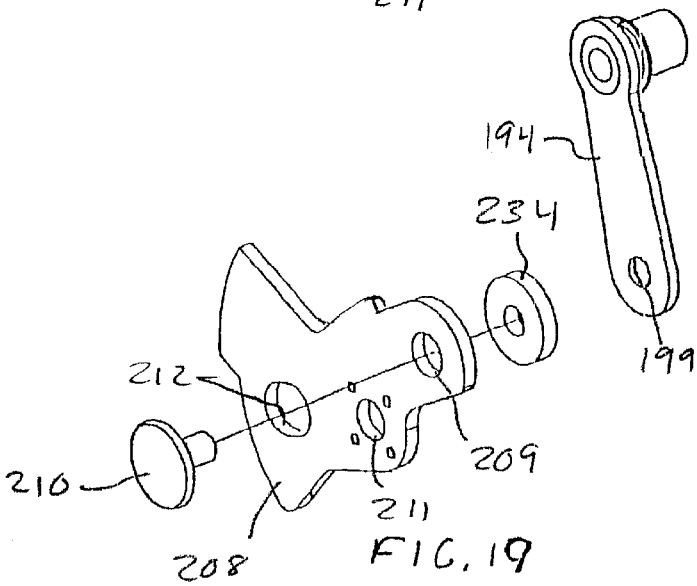

Referring to FIGS. 17–19, each lower link 194 is interconnected with a crank 208 via a pivotal rivet 210 disposed through an opening 199 in lower link 194 and an opening 209 in crank 208. Each crank 208 pivots about a center 211. Crank 208 has an opening 212 where cross pin 40 (FIG. 2) passes through into arcuate slot 52 of cassettes 32, 34 and 36 (FIG. 2) and a complementary set of arcuate slots 214 on each side frame 86 (FIG. 10).

A spacer 234 is included on each pivotal rivet 210 between each lower link 194 and crank 208. Spacers 234 spread the force loading from lower links 194 to cranks 208 over a wider base, and also reduces friction between lower links 194 and cranks 208, thereby minimizing the likelihood of binding (e.g., when operating mechanism 38 is changed from the "off" position to the "on" position manually or mechanically, or when operating mechanism 38 is changed from the "on" position to the "tripped" position of the release of primary latch 126 and secondary latch 138).

Referring back to FIGS. 5–7, the movement of operating mechanism 38 relative to rotary contact assembly 56 will be detailed.

Referring to FIG. 5, in the "off" position toggle handle 44 is rotated to the left and mechanism springs 96, lower link 194 and crank 208 are positioned to maintain contact arm 68 so that movable contacts 72, 74 remain separated from stationary contacts 64, 66. Operating mechanism 38 becomes set in the "off" position after a reset force properly aligns primary latch 126, secondary latch 138 and cradle 106 (e.g., after operating mechanism 38 has been tripped) and is released. Thus, when the reset force is released, extensions 166 of primary latch 126 rest upon cradle latch surfaces 164, and primary latch surfaces 158 rest upon secondary latch surfaces 162. Each upper link 174 and lower link 194 are bent with respect to each side tube 203. The line of forces generated by mechanism springs 96 (i.e., between spring anchor 98 and pin 202) is to the left of bearing portion 94 (as oriented in FIGS. 3–5). Cam surface 171 of upper link 174 is out of contact with roller 173.

Referring now to FIG. 6, a manual closing force was applied to toggle handle 44 to move it from the "off" position (i.e., FIG. 5) to the "on" position (i.e., to the right as oriented in FIG. 6). While the closing force is applied, upper links 174 rotate within arcuate slots 168 of cradles 106 about pins 188, and lower link 194 is driven to the right under bias of the mechanism spring 96. Raised portions 189 and 192 (FIG. 12 and 13) maintain a suitable space between the surfaces of upper links 174 and cradles 106 to prevent friction therebetween, which would increase the required set operating mechanism 38 from "off" to "on". Furthermore, side walls 197 of bearing washers 196 (FIGS. 14–16) maintain the position of upper link 174 on side tube 203 and minimize likelihood of binding (e.g., so as to prevent upper link 174 from shifting into springs 96 or into lower link 194).

To align vertical leg 176 and lower link 194, the line of force generated by mechanism springs 96 is shifted to the right of bearing portion 94, which causes rivet 210 coupling lower link 194 and crank 208 to be driven downwardly and to rotate crank 208 clockwise about center 211. This, in turn, drives cross pin 40 to the upper end of arcuate slot 214. Therefore, the forces transmitted through cross pin 40 to rotary contact assembly 56 via opening 82 drive movable contacts 72, 74 into stationary contacts 64, 66. Each spacer 234 on pivotal rivet 210 (FIGS. 11 and 17–19) maintain the appropriate distance between lower links 194 and cranks 208 to prevent interference or friction therebetween or from side frames 86.

The interface between primary latch 126 and secondary latch 138 (i.e., between primary latch surface 158 and secondary latch surface 162), and between cradles 106 and primary latch 126 (i.e., between extensions 166 and cradle latch surfaces 164) is not affected when a force is applied to toggle handle 44 to change from the "off" position to the "on" position.

Referring now to FIG. 5, in the "tripped" condition, secondary latch trip tab 146 has been displaced, e.g., by the draw out interlock mechanism, described in detail below, and the interface between primary latch 126 and secondary latch 138 is released. Extensions 166 of primary latch 126 are disengaged from cradle latch surfaces 164, and cradles 106 is rotated clockwise about pin 108 (i.e., motion guided by rivet 116 in arcuate slot 118). The movement of cradle 106 transmits a force via rivets 188, 191 to upper link 174 having cam surface 171. After a short predetermined rotation, cam surface 171 of upper link 174 contacts roller 173. The force resulting from the contact of cam surface 171 on roller 173 causes upper link 174 and lower link 194 to buckle and allows mechanism springs 96 to pull lower link 194 via pin 202. In turn, lower link 194 transmits a force to crank 208 (i.e., via rivet 210) causing crank 208 to rotate counter clockwise about center 211 and drive cross pin 40 to the lower portion of arcuate slot 214. The forces transmitted through cross pin 40 to rotary contact assembly 56 via opening 82 cause movable contacts 72, 74 to separate from stationary contacts 64, 66.

Figure 20:
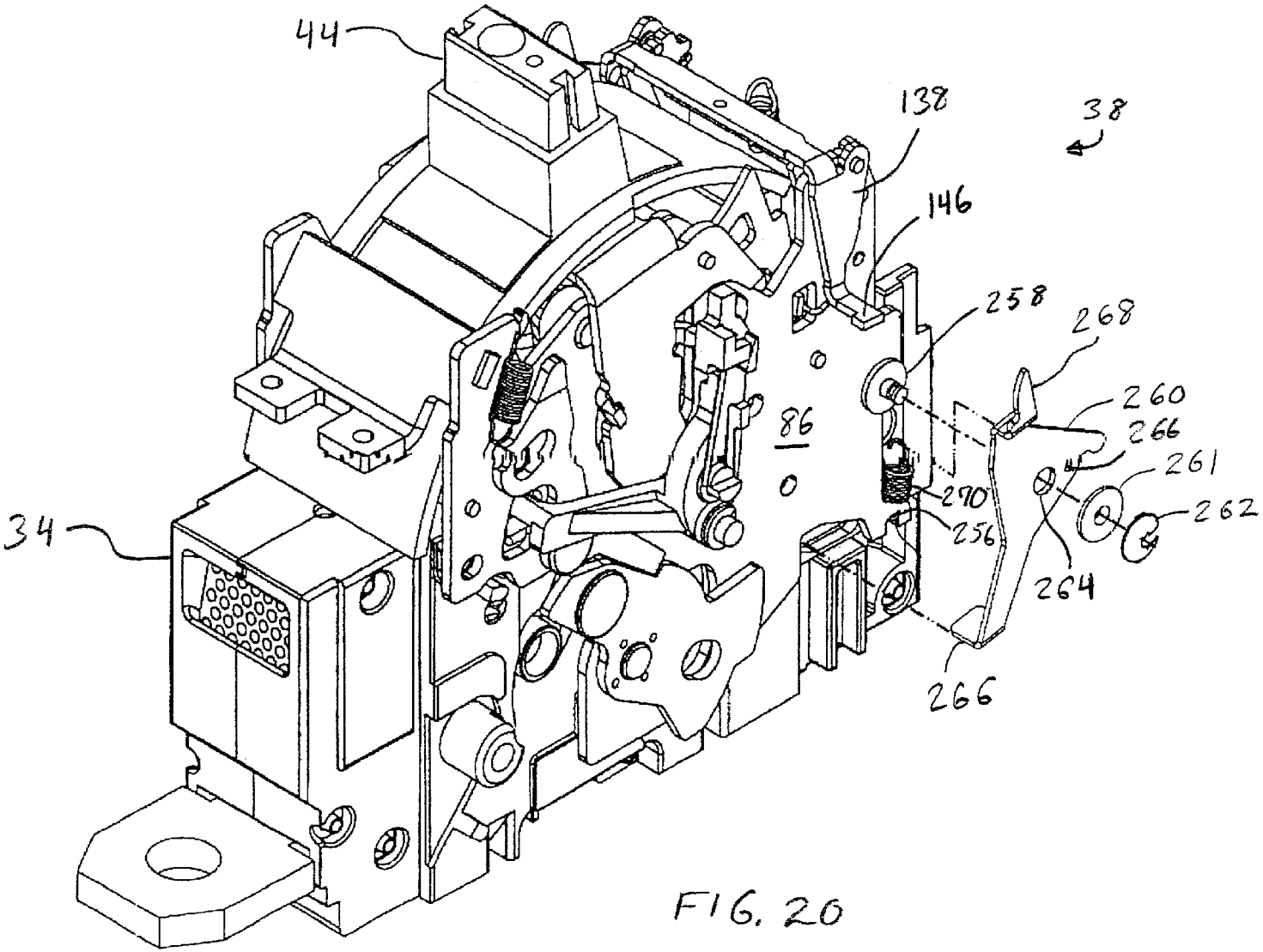
FIG. 20 is an isometric view of a the operating mechanism showing how portions of the draw out interlock mechanism is attached.
Figure 21:
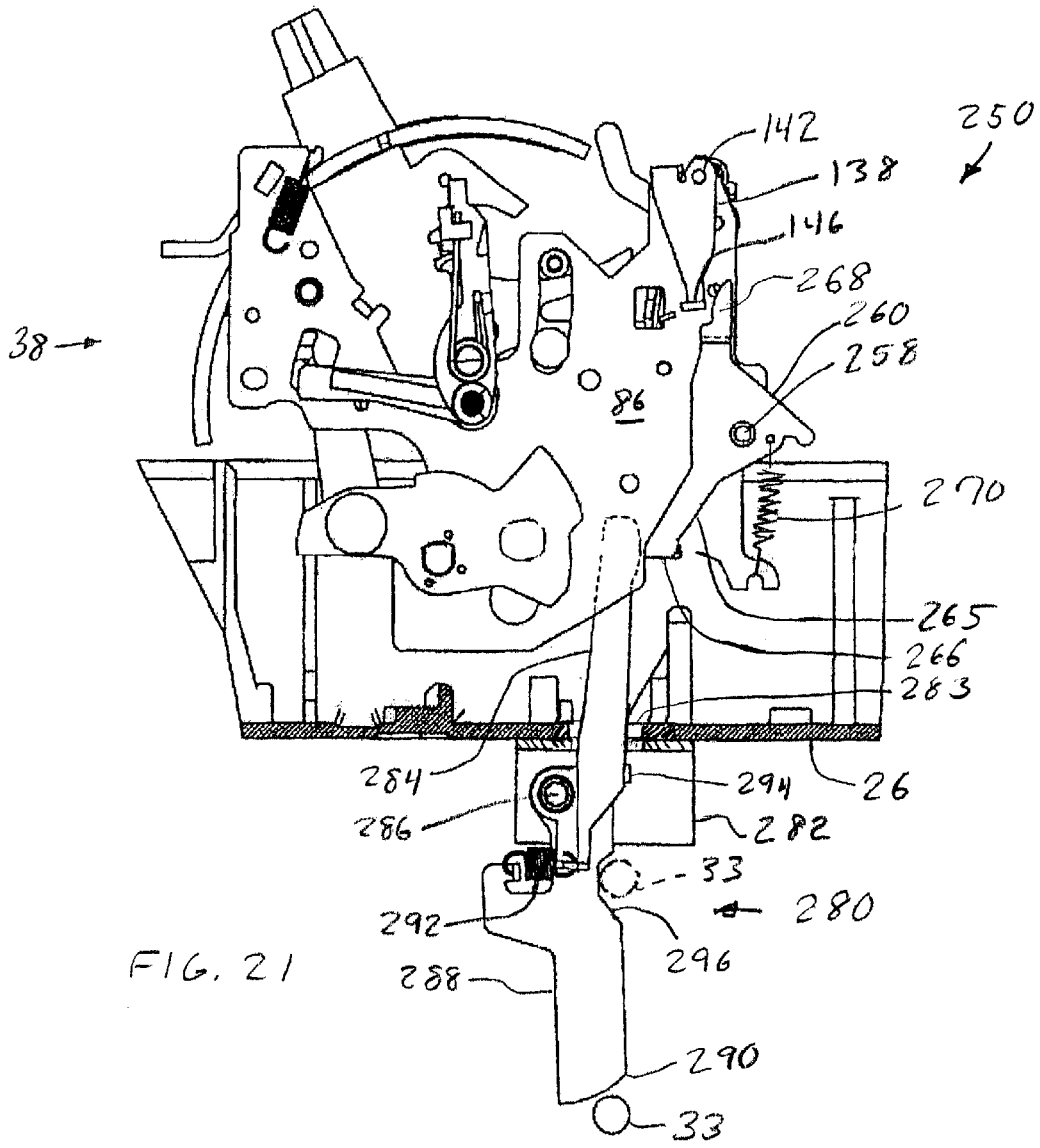
FIG. 21 is a partial view of operating mechanism 38 with the draw out interlock mechanism attached.
Figure 22:
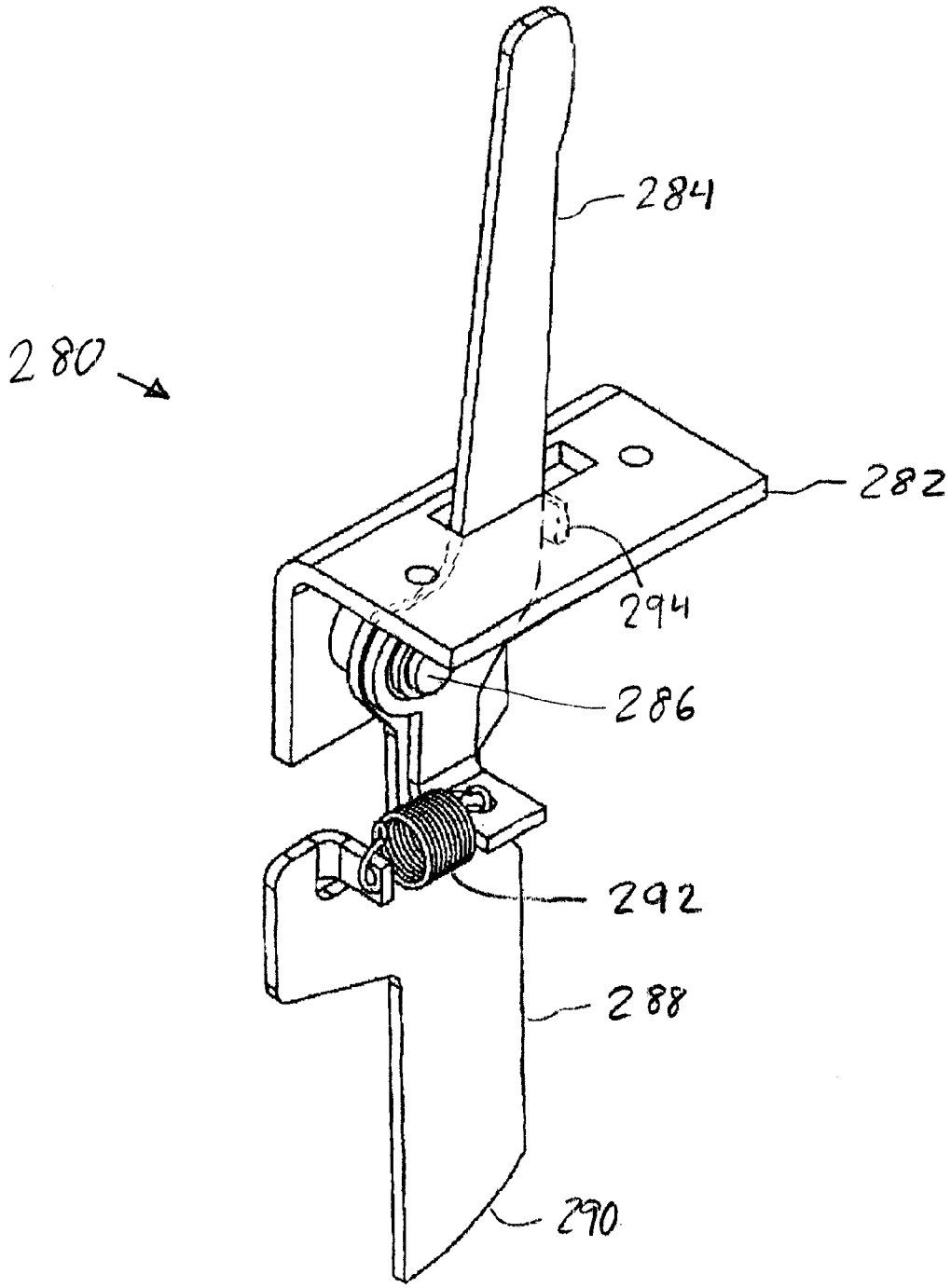
FIG. 22 is a detail view of components of the draw out interlock mechanism.

Referring now to FIGS. 20–22, the draw out interlock mechanism 250 will be described in detail. Pivot pin 258 is riveted to a side frame 86 of operating mechanism 38. Draw out trip arm 260 includes a first extension 268 at an upper end, a draw out trip tab 266 formed on a second extension 265 on a lower end, and an aperture 264 (FIG. 20) that is placed over pin 258. Draw out trip arm 260 is pivotally locked into place with bushing 261 by forcing retainer clip 262 over a circumferential groove formed into pin 258 so that it is free to rotate on pin 258 between bushing 261 and a shoulder formed into pin 258. A return spring 270 is connected between notch 256 formed into sidewall 86 and a small aperture 266 formed in draw out trip arm 260.

Shown in FIG. 21 is interlock activating assembly 280 attached to base 26 of circuit breaker 20 (FIGS. 1 and 4). Interlock activating assembly 280 is shown in further detail in FIG. 22, and comprises a mounting bracket 282, an extended arm 284 which pivots about pin 286, a camming arm 288 which also pivots on pin 286. In one embodiment (not shown), extended arm 284 and camming arm 288 are fixed to one another or formed as a unitary structure. In the embodiment shown, take up spring 292 biases extended arm 284 against stop 294 of camming arm 288, as best seen in FIG. 21. Camming arm 288 has a cam surface 290. Interlock activating assembly 280 is installed onto base 26 of circuit breaker 20 with extended arm 284 extending through aperture 283 formed into base 26. It will be appreciated that installation of draw out trip mechanism 250 onto a fully-assembled operating mechanism 38 can be accomplished in only a few steps and does not require any disassembly of the operating mechanism 38.

FIG. 21 clearly shows the operation of draw out trip mechanism 250. Draw out trip mechanism 250 causes draw out circuit breaker 20 to trip when inserted or removed from compartment 25. Compartment 25 includes a camming surface 33 which may be a pin, roller, or other surface such as shown in FIG. 3. When draw out circuit breaker 20 is installed into compartment 25 (FIGS. 3 and 4) camming surface 33 will contact cam surface 290 causing camming arm 288 to rotate in a clockwise direction as seen in FIG. 21. When camming arm 288 rotates clockwise, stop 294 moves to the right, allowing extended arm 284 to rotate clockwise under influence of take up spring 292, which is under tension.

Extended arm 284 interacts with draw out trip tab 266 formed at the bottom of second extension 265 of draw out trip arm 260, causing draw out trip arm 260 to rotate counterclockwise as seen in FIG. 21, against the bias of spring 270. When draw out trip arm 260 is rotated counter clockwise, first extension 268 interacts with trip tab 146 of secondary latch 138, causing the secondary latch 138 to rotate in a clockwise direction on pins 142. This causes operating mechanism 38 to trip as previously described, causing contact arm 68 to rotate, thereby separating moving contacts 74, 72 from stationary contacts 66, 64. Take up spring 292 allows for additional rotation of camming arm 288 to occur to assure positive tripping, while excess motion is taken up, ensuring desired operation while allowing for manufacturing variations.

When circuit breaker 20 is fully installed into compartment 25, camming pin 33 is in the position shown in phantom in FIG. 21. Notch 296 formed into camming arm 288, allows camming arm 288 and extended arm 284 to rotate back to a natural position under the influence of return spring 270. This position allows secondary latch 138 to be released, permitting the moving and stationary contacts in draw out circuit breaker 20 to be closed by moving handle yoke 88 to the "on" position shown in FIG. 6. It will be appreciated that a similar tripping occurs due to the interaction of camming surface 33 and camming arm 288 when circuit breaker 20 is removed from compartment 25 as when circuit breaker 20 is inserted into compartment 25.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A draw out interlock mechanism for a draw out circuit breaker, the draw out interlock mechanism comprising: a draw out trip arm coupled within said draw out circuit breaker so that said draw out trip arm is pivotable with respect to said draw out circuit breaker, said draw out trip arm comprising:

a first extension on a first end of said draw out trip arm for interacting with a trip latch of said operating mechanism, and a second extension formed on a second end of said draw out trip arm; and an interlock activating assembly, said interlock activating assembly comprising:

a mounting bracket for attaching said interlock activating assembly to said draw out circuit breaker, and an extended arm and a camming arm, said extended arm and said camming arm pivotally attached to a pin that is mounted to the mounting bracket, said extended arm extending through an aperture in said draw out circuit breaker with an end thereof proximate to said second extension of said draw out trip arm when said mounting bracket is installed on said draw out circuit breaker;

wherein said camming arm interacts with a camming surface attached to a compartment such that when said draw out circuit breaker is inserted into said compartment, said camming arm and said extended arm separately rotate in a first direction, said extended arm interacting with said second extension of said draw out trip arm causing said draw out trip arm to rotate in a second direction, causing said first extension to interact with said trip latch causing said draw out circuit breaker to trip; and wherein said extended arm and said camming arm are connected by a take up spring that allows over-rotation of said camming arm with respect to said extended arm.

2. The draw out interlock mechanism of claim 1 wherein said draw out trip arm further comprises a return spring biasing said first extension away from said trip latch.

3. The draw out interlock mechanism of claim 1 wherein said camming arm includes a first surface and said camming surface comprises a pin mounted in said compartment, wherein as said draw out circuit breaker is inserted, said first surface rides against said pin, forcing said camming arm to rotate in said first direction.

4. The draw out interlock mechanism of claim 3 wherein said camming arm further includes a second surface, configured such that as said draw out circuit breaker is inserted, said first surface forces said camming arm to rotate in said first direction, then said second surface allows said camming arm to rotate back in said second direction so that when said draw out circuit breaker is fully inserted in said compartment, said draw out circuit breaker is allowed to be reset.

5. The draw out interlock mechanism of claim 1 wherein said camming arm and said camming surface are configured to interact with each other so that as said draw out circuit breaker is inserted, said camming arm rotates in said first direction, then said camming arm rotates back in said second direction so that when said draw out circuit breaker is fully inserted in said compartment, said draw out circuit breaker is allowed to be reset.

6. The draw out interlock mechanism of claim 1 wherein said draw out interlock mechanism is attached to a side plate of a circuit breaker operating mechanism.

7. A draw out circuit breaker comprising:

a movable contact and a fixed contact electrically connected in series between a load side stab and a line side stab for each pole of said draw out circuit breaker;

an operating mechanism for causing said movable and fixed contacts to open and close, said operating mechanism including:

an "off" state wherein said movable contact and said fixed contact are open, an "on" state wherein said movable contact and said fixed contact are closed, and a "tripped" state wherein said movable contact and said fixed contact are open;

said operating mechanism further comprising a trip latch for switching said operating mechanism from said on state to said tripped state when said trip latch is moved; and a draw out interlock mechanism comprising:

a draw out trip arm pivotally attached within said circuit breaker, said draw out trip arm comprising:

a first extension on a first end of said draw out trip arm for interacting with said trip latch, and a second extension on a second end of said draw out trip arm; and an interlock activating assembly, said interlock activating assembly comprising:

an extended arm, a camming arm, and a support bracket mounted to the draw out circuit breaker with said extended arm extending through an aperture in said draw out circuit breaker with an end of said extended arm proximate said second extension of said draw out trip arm;

wherein said extended arm and said camming arm are pivotally attached to a pin mounted to the support bracket, said camming arm interacts with a camming surface attached to a compartment such that when and said draw out circuit breaker is inserted into said compartment, said camming arm and said extended arm rotate in a first direction, said extended arm interacts with said second extension of said draw out trip arm causing said draw out trip arm to rotate in a second direction, in turn causing said first extension of said draw out trip arm to interact with said trip latch causing said draw out circuit breaker to trip, separating said movable and fixed contacts; and wherein said extended arm and said camming arm are connected by a take up spring that allows over-rotation of said camming arm with respect to said extended arm.

8. The draw out circuit breaker of claim 7 wherein said draw out trip arm further comprises a return spring biasing said first extension away from said trip latch.

9. The draw out circuit breaker of claim 7 wherein said camming arm includes a first surface and said camming surface comprises a pin mounted in said compartment, wherein as said draw out circuit breaker is inserted, said first surface rides against said pin, forcing said camming arm to rotate in said first direction.

10. The draw out circuit breaker of claim 9 wherein said camming arm further includes a second surface, configured such that as said draw out circuit breaker is inserted, said first surface forces said camming arm to rotate in said first direction, then said second surface allows said camming arm to rotate back in said second direction so that when said draw out circuit breaker is fully inserted in said compartment, said draw out circuit breaker is allowed to be reset and said contacts to be closed.

11. The draw out circuit breaker of claim 7 wherein said camming arm and said camming surface are configured to interact with each other so that as said draw out circuit breaker is inserted, said camming arm rotates in said first direction, then said camming arm rotates back in said second direction so that when said draw out circuit breaker is fully inserted in said compartment, said draw out circuit breaker is allowed to be reset and said contacts to be closed.

12. The draw out circuit breaker of claim 7 wherein said draw out interlock mechanism is attached to a side plate of a circuit breaker operating mechanism.

13. A draw out circuit breaker comprising:

a movable contact and a fixed contact electrically connected in series between a load side stab and a line side stab for each pole of said draw out circuit breaker;

an operating mechanism for causing said movable and fixed contacts to open and close; and a draw out interlock mechanism comprising:

a draw out trip arm pivotally attached to said operating mechanism, said draw out trip arm comprising:

a first extension on a first end of said draw out trip arm for interacting with said trip latch, and a second extension on a second end of said draw out trip arm; and an interlock activating assembly, said interlock activating assembly comprising:

an extended arm, a camming arm, and a support bracket mounted to the draw out circuit breaker with said extended arm extending through an aperture in said draw out circuit breaker with an end of said extended arm proximate said second extension of said draw out trip arm; and wherein said extended arm and said camming arm are pivotally attached to a pin mounted to the support bracket, said camming arm interacts with a camming surface attached to a compartment such that when and said draw out circuit breaker is inserted into said compartment, said camming arm and said extended arm rotate in a first direction, said extended arm interacts with said second extension of said draw out trip arm causing said draw out trip arm to rotate in a second direction, in turn causing said first extension of said draw out trip arm to interact with said trip latch causing said draw out circuit breaker to trip, separating said movable and fixed contacts; and wherein said extended arm and said camming arm are connected by a take up spring that allows over-rotation of said camming arm with respect to said extended arm.

* * * * *